US006446455B1

(12) United States Patent
Sohn et al.

(10) Patent No.: US 6,446,455 B1
(45) Date of Patent: Sep. 10, 2002

(54) PERSONAL AIR CONDITIONER

(75) Inventors: Sang Bum Sohn; Cheol O Ahn, both of Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/770,451

(22) Filed: Jan. 29, 2001

(30) Foreign Application Priority Data

Sep. 8, 2000 (KR) ..... 2000-53451
Oct. 5, 2000 (KR) ..... 2000-58461

(51) Int. Cl.[7] ..... F25D 19/00; F25D 23/12; F25B 3/00

(52) U.S. Cl. ..... 62/298; 62/297; 62/262; 62/499

(58) Field of Search ..... 62/285, 262, 263, 62/298, 297, 499

(56) References Cited

U.S. PATENT DOCUMENTS 2,633,718 A * 4/1953 Wile ..... 62/263
2,708,833 A * 5/1955 Nigro ..... 62/262
2,708,835 A * 5/1955 Nigro ..... 62/262
3,205,676 A * 9/1965 Walker et al. ..... 62/285
3,611,743 A * 10/1971 Manganaro ..... 62/263
3,740,964 A * 6/1973 Herweg ..... 62/262
3,777,506 A * 12/1973 Hergatt et al. ..... 62/237
3,802,216 A * 4/1974 Brandimarte ..... 62/262

* cited by examiner

*Primary Examiner*—William C. Doerrler
(74) *Attorney, Agent, or Firm*—Birch, Stewart, Kolasch & Birch, LLP

(57) ABSTRACT

Personal air conditioner including a heat discharging part having small sized compressor and condenser, a heat absorbing part having a small sized evaporator, a flexible high pressure pipe line connecting between the condenser and the evaporator, and a flexible low pressure pipe line connecting between the evaporator and the compressor, thereby installation and moving of the heat discharging part and the heat absorbing part are convenient, to allow an intensive cooling of a particular space.

6 Claims, 7 Drawing Sheets

PERSONAL AIR CONDITIONER

BACKGROUND OF THE INVENTION

1. Field of the Invention

The present invention relates to an air conditioner, and more particularly, to a personal or particular space air conditioner, which can be installed at a desired located and fashion enough to permit air conditioning, not for an entire air conditioning space, but for a particular space.

2. Background of the Related Art

The air conditioner maintains a temperature, a humidity, and the like of a desired space (air conditioned space) at appropriate states by using a refrigerating cycle of compression, condensation, expansion, and evaporation of a refrigerant. In the air conditioner, there are package type air conditioners and room air conditioners. In general, the air conditioner has a heat discharging part with the condenser and a heat absorbing part with the evaporator arranged in separate places. And, since the heat discharging part is arranged outside of the room, the heat discharging part is called as an outdoor unit, and, since the heat absorbing part is arranged inside the room, the heat absorbing part is called as an indoor unit. A related art room air conditioner will be explained with reference to FIG. 1.

A heat discharging part 5 is arranged outside of the room, and the heat absorbing part 3 is arranged inside of the room. For an example, the heat absorbing part 3 is fixed to a wall, and the heat discharging part 5 is placed on a veranda or the like. There is refrigerant pipe lines connected between the heat absorbing part 3 and the heat discharging part 5 for flow of the refrigerant. And, there is a drain hose 9 connected to the heat absorbing part 3 for discharging the condensate formed at the evaporator of the heat absorbing part 3.

A system of the heat absorbing part will be explained, with reference to FIG. 2. The heat absorbing part 3 is provided with an evaporator 37 and a fan 38 fitted inside thereof. And, there is a suction grill 33 in front portion of a body 31 of the heat absorbing part, for drawing air from the room, and a discharge grill 35 below the body 31 of the heat absorbing part, for discharging cooled air heat exchanged with the evaporator 37 into the room again.

The operation of the related art air conditioner will be explained, with reference to FIGS. 1 and 2.

The room air flowed into the suction grill 33 is cooled down as the room air is heat exchanged at the evaporator 37, and discharged into the room again, for maintaining the room temperature at a preset level. The evaporated refrigerant is provided to a compressor in the heat discharging part 5 through a low pressure pipe line 7*b,* and compressed and provided to the condenser. The refrigerant makes heat exchange with external air at the condenser to condense the refrigerant and discharge heated air outside of the room. The condensed refrigerant is expanded at an expansion valve and flows to the evaporator 37 through a high pressure pipe line 7*a* again. By repeating the foregoing process, the room, i.e., the air conditioned space 1 can be maintained at a desired temperature.

In the meantime, water drops are formed on a surface of the evaporator 37 during heat exchange between the room air and the refrigerant at the evaporator 37 in the heat absorbing part 3, because a surface temperature of the evaporator 37 is very low compared to the room temperature, to cool down the room air in contact with the evaporator 37 below a dew point of the air. The water drops formed at the evaporator 37 are collected at a place along a drain channel 39 in the heat absorbing part 3, and drained to outside of the room through a drain hose 9.

However, the related art air conditioner has the following problems.

First, the related art air conditioner in general is bulky and heavy such that installation of the air conditioner is not convenient. And, moving once installed indoor unit or outdoor unit to another place is difficult, since the refrigerant pipe lines are formed of copper tubes, and passed through a wall for fastening at desired locations.

Second, the transfer of cooled air from the heat absorbing part to a distant place from the heat absorbing part takes much time period, to require a long time period in cooling down the distant place. And, an intensive local air conditioning for a particular space, not the entire air conditioning space, has not been possible. If moving the air conditioner to a space where air conditioning is required is possible, the intensive air conditioning for the particular space can be made available, that is in fact not possible by using the related art air conditioner.

Third, even though the discharge grill in the heat discharging part has means for regulating a blow direction, the blow direction regulation has a limitation since the heat absorbing part itself is fixed to wall or the like.

Therefore, development of a particular space cooling, or personal(small sized) air conditioner is required, which is convenient and simple in installation and movement, enough to permit an instant cooling of, not the entire air conditioning space, but a particular space.

SUMMARY OF THE INVENTION

Accordingly, the present invention is directed to a personal air conditioner that substantially obviates one or more of the problems due to limitations and disadvantages of the related art.

An object of the present invention is to provide a personal air conditioner which can be installed and moved with easy to permit an effective air conditioning of a particular space.

Another object of the present invention is to provide a personal air conditioner, of which direction of cooled air discharge from a heat absorbing part can be regulated, freely.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the personal air conditioner includes a heat discharging part having small sized compressor and condenser, a heat absorbing part having a small sized evaporator, a flexible high pressure pipe line connecting between the condenser and the evaporator, and a flexible low pressure pipe line connecting between the evaporator and the compressor, thereby installation and moving of the heat discharging part and the heat absorbing part are convenient. The high pressure pipe line and the low pressure pipe line are preferably detachable. Thus, since coupling and separation of the heat discharging part and the heat absorbing part are possible, fast cooling down of a desired space is possible.

The personal air conditioner further includes heat absorbing part fixing means having one end connected to the heat absorbing part and the other end supported on a desired location.

The heat absorbing part fixing means includes a base movable and supported on a desired location, a first supporting member fixed on the base, and a second supporting member having one end height adjustably coupled to the first supporting member and the other end rotatably coupled to the heat absorbing part. And, the personal air conditioner further includes angle adjusting means in a lower portion of the second supporting member for adjusting an angle in up and down direction.

Thus, the personal air conditioner of the present invention can cool down a desired space within a short time period because installation and movement of the heat discharging part and the heat absorbing part are convenient, and cooled air from the heat absorbing part can be directed as desired.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENT

Figure 1:
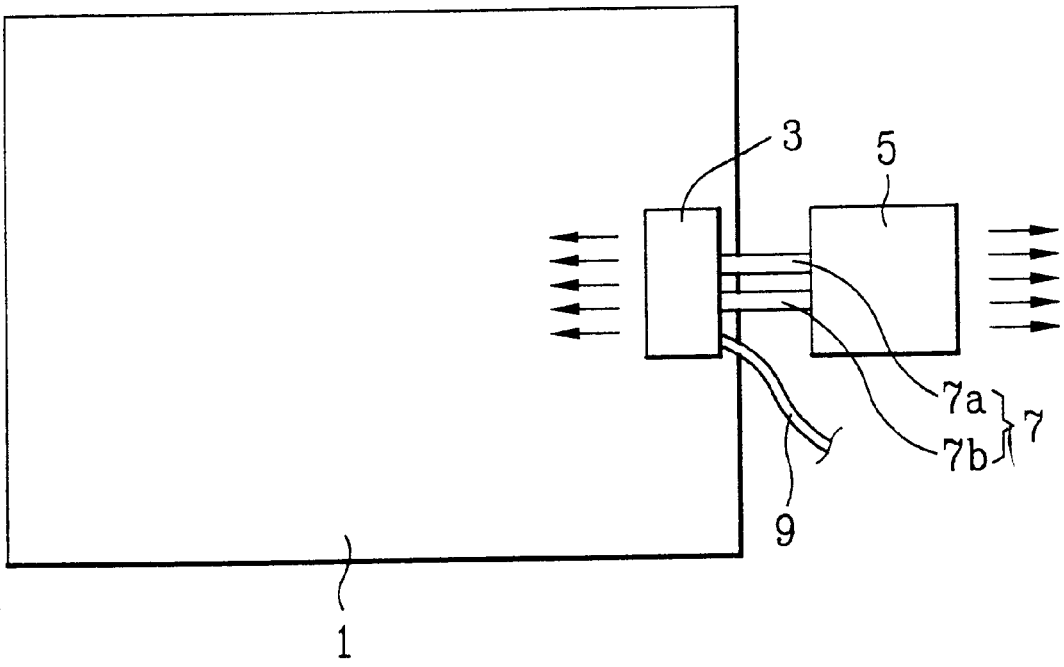
FIG. 1 Related Art
FIG. 1 illustrates a related art air conditioner schematically for showing an installation state thereof.
Figure 2:
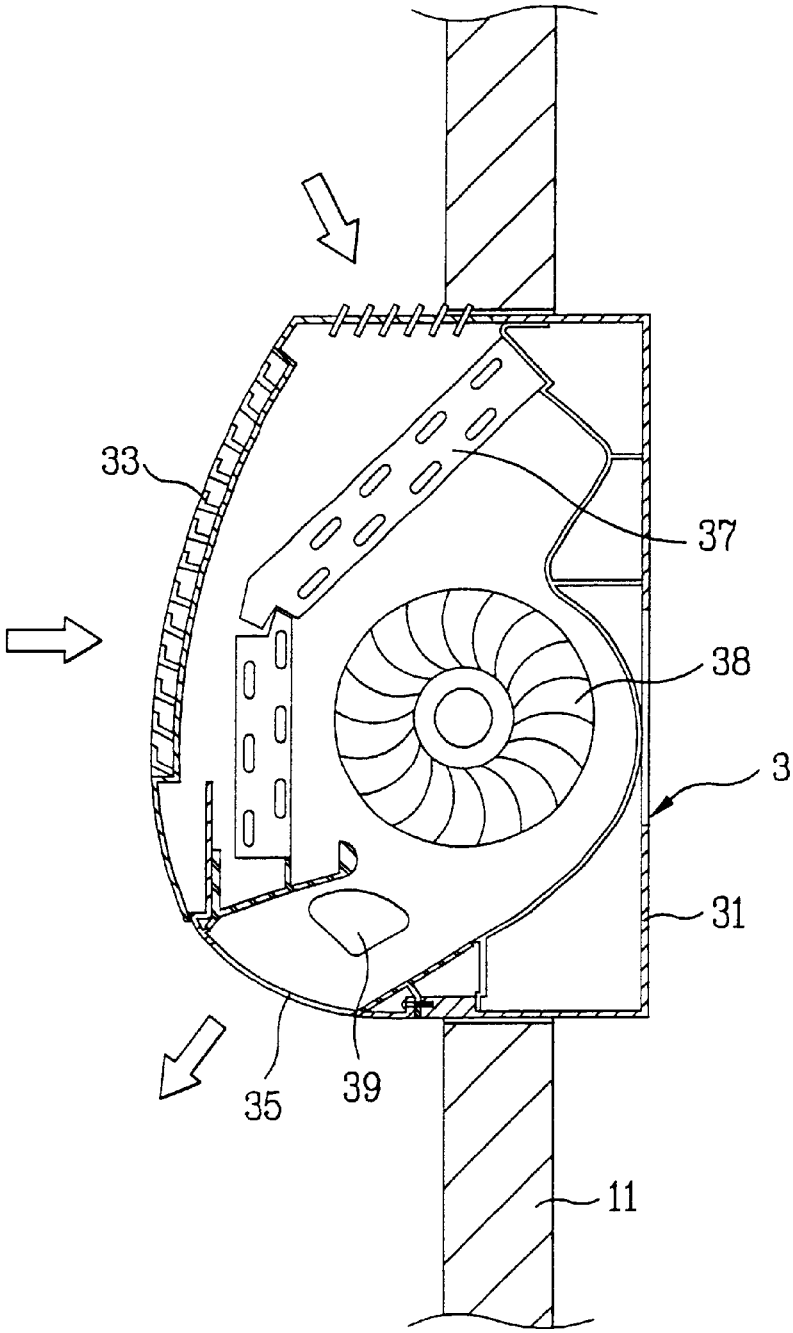
FIG. 2 Related Art
FIG. 2 illustrates a section of a heat absorbing part(indoor unit) of a related art air conditioner installed in a wall.
Figure 3:
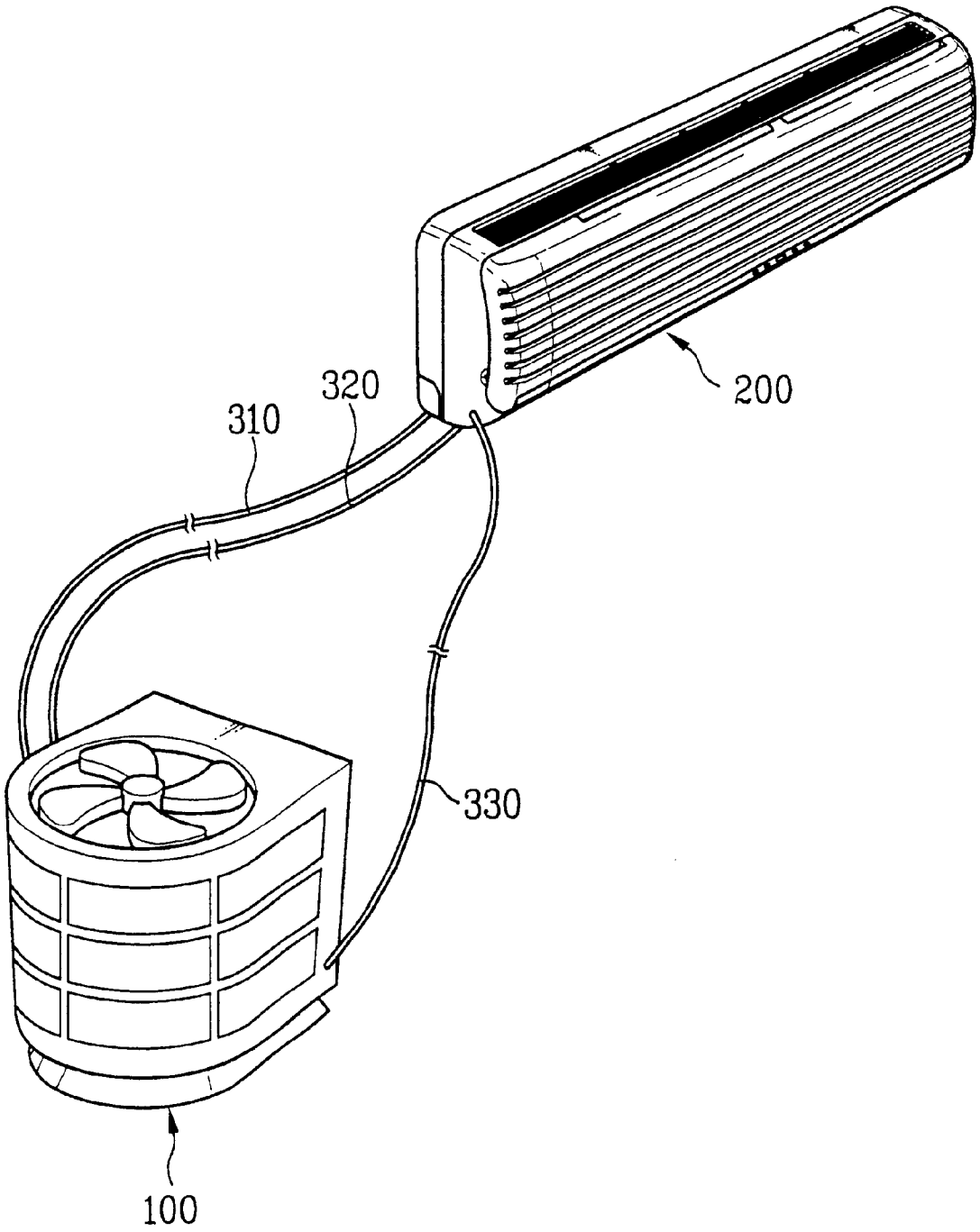
FIG. 3 illustrates a perspective view of a personal air conditioner in accordance with a preferred embodiment of the present invention.

Reference will now be made in detail to the preferred embodiments of the present invention, examples of which are illustrated in the accompanying drawings. A personal air conditioner in accordance with a preferred embodiment of the present invention will be explained with reference to FIG. 3. Alike the related art air conditioner, the air conditioner of the present invention also includes a compressor, a condenser, an expansion valve, an evaporator and the like, for employing the refrigerating cycle. Of course, the condenser is in the heat discharging part 100, and the evaporator is in the heat absorbing part 200. And, though it is desirable that the compressor and the expansion valve are provided to the heat discharging part, the compressor and the expansion valve may be provided to the heat absorbing part. And, the heat discharging part 100 and the heat absorbing part 200 have fans respectively, for enhancing a heat exchange efficiency. However, since a purpose of the air conditioner of the present invention lies on cooling a local space, an air conditioner with a small cooling capacity is acceptable, with consequential small sized components in the personal air conditioner, such as compressors and the like, along with the heat absorbing part 200 and heat discharging part 100, that renders a convenience in moving and installation of the air conditioner. Moreover, it is preferable that the high pressure pipe line 310 and the low pressure pipe line 320 are formed of flexible material for improving the convenience in moving and installation of the air conditioner, and detachably connected between the heat absorbing part 200 and the heat discharging part 100 by means of quick coupling or the like, for easy installation and moving of the heat absorbing part 200 and the heat discharging part 100, when it is required to take an appropriate measure for refilling the refrigerant. On the other hand, in general, one end of the drain hose 330 is connected to the heat absorbing part 200, and the other end is exposed to outside of the room for discharging the condensate outside of the room. However, it is preferable for the personal air conditioner of the present invention that the other end of the drain hose 330 is connected to the heat discharging part 100, because, as the heat discharging part 100 is in general installed outside of the room, it is convenient in view of installation that the condensate is transferred to the heat discharging part 100 and discharge the condensate to outside of the room therefrom. It is of course preferable that the drain hose 330 is also formed of a flexible material.

A configuration of installation of the air conditioner of the present invention will be explained, with reference to FIGS. 4 and 5. Because the related art air conditioner is bulky, it has been difficult for the user to install the air conditioner for himself, actually. However, the air conditioner of the present invention has small and light heat discharging part 100 and heat absorbing part 200 and flexible pipe lines, installation of which is easy, the user can install it at a desired location with easy.

Figure 4:
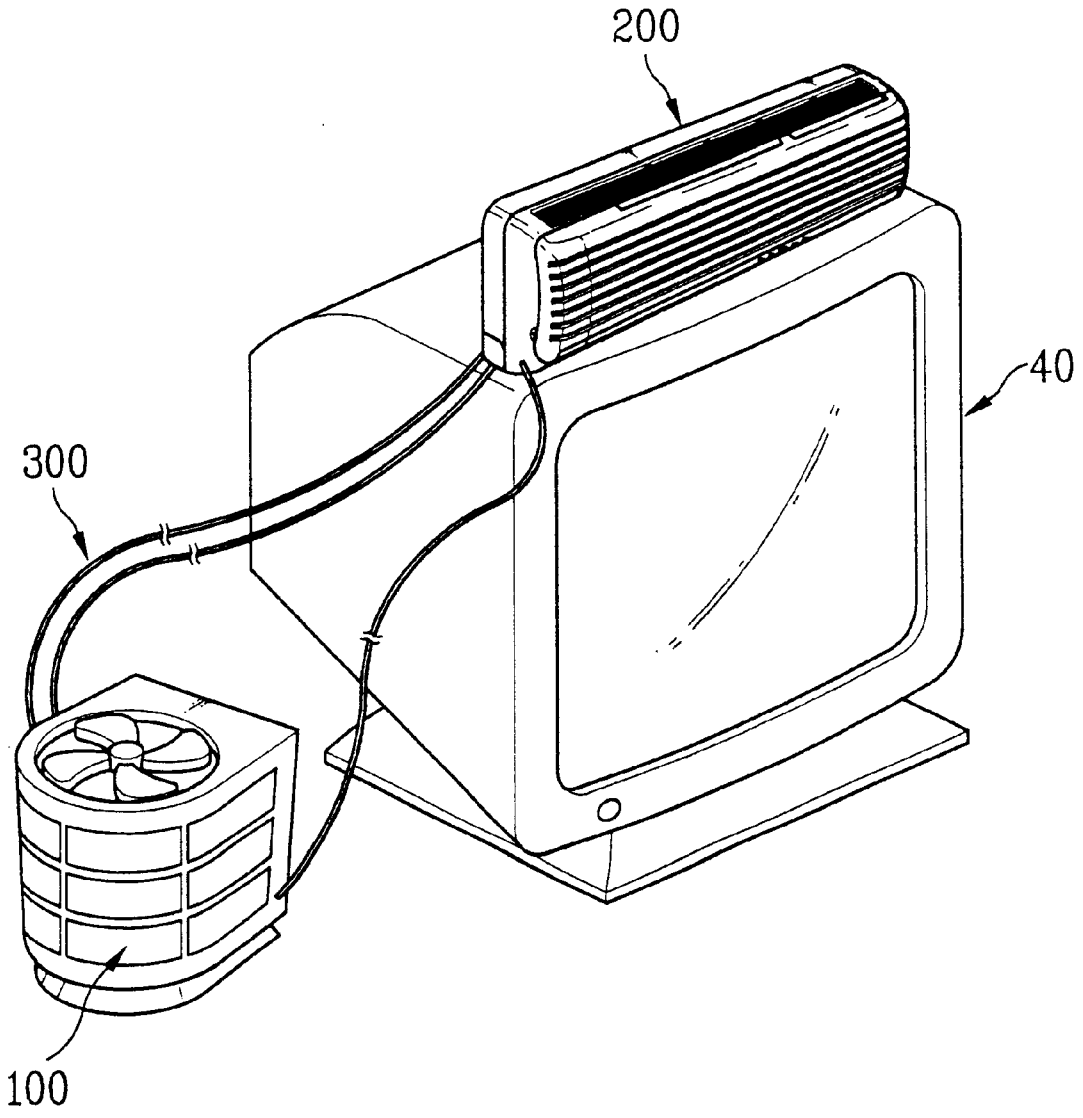
FIG. 4 illustrates a perspective view of a personal air conditioner of the present invention for showing one example of an installation state thereof.
Figure 5:
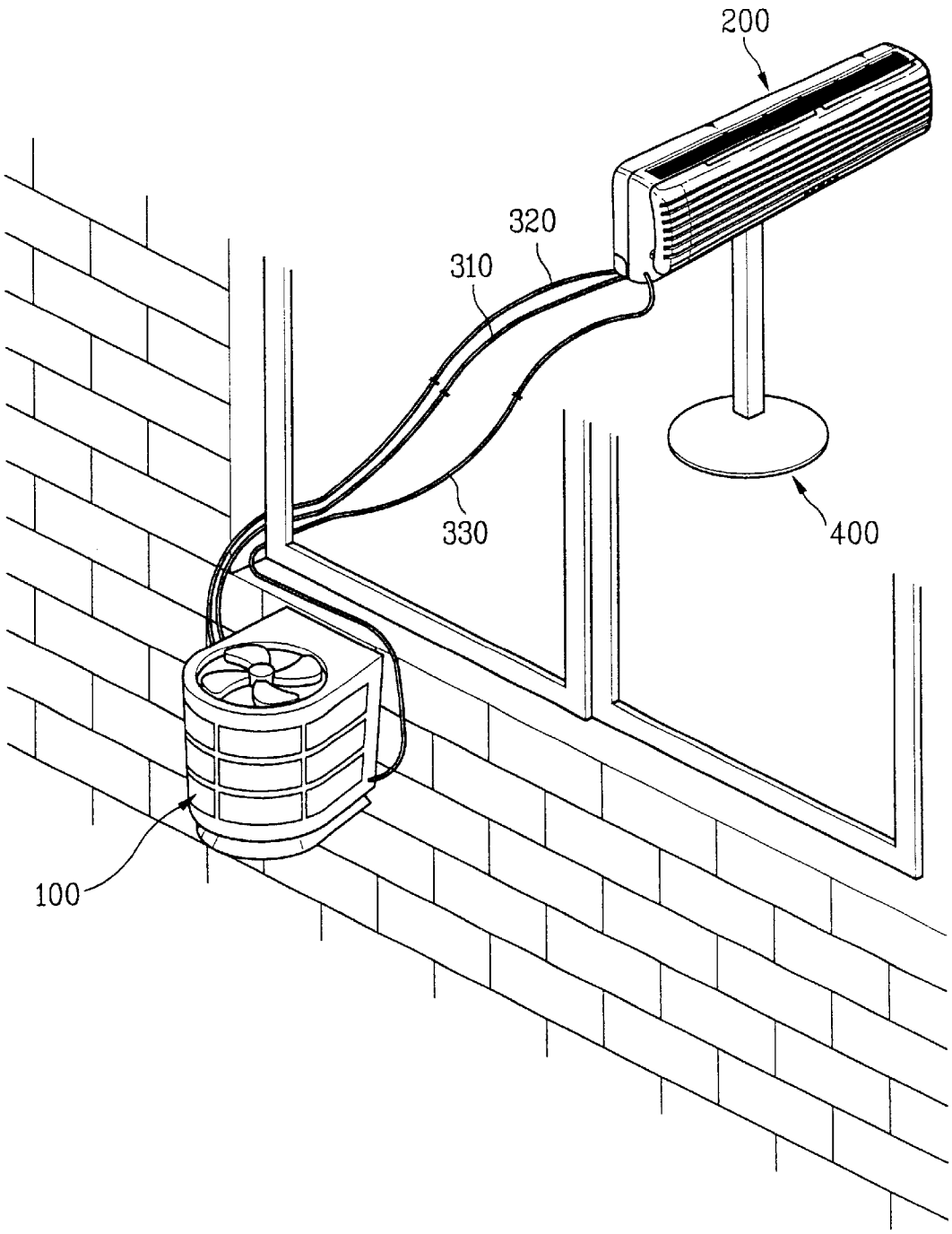
FIG. 5 illustrates a perspective view of a personal air conditioner of the present invention for showing another example of an installation state thereof.

Referring to FIG. 4, the heat discharging part 100 may be installed, for an example, on a veranda or fixed to an outer side of a wall, and the heat absorbing part 200 may be placed on a desired location in a room, for an example, on a computer monitor 40. Of course, since the heat absorbing part 200 and the heat discharging part 100 is movable, the location is not limited to this, but the heat absorbing part 100 can be placed on a TV receive.r or a desk, or the like. As shown in FIG. 5, it is possible to fix the heat absorbing part 200 to a heat absorbing part fixing means 400 for easy placing of the heat absorbing part 200 at a desired place. And, though a hole is required to be made in a wall for the refrigerant pipe lines connecting the heat absorbing part 200 and the heat discharging part 100 in the related art air conditioner, the air conditioner of the present invention permits connection of the pipe lines through a window as the pipe lines are small and flexible. Other than the foregoing method for installing the heat absorbing part 200, various methods are available. For an example, the heat absorbing part 200 may be mounted on a wall, or installed by other different methods to a desired location.

In the meantime, since the heat discharging part 100 of the present invention is small, a plurality of the heat discharging parts 100 may be installed. And, both the heat absorbing part 200 and the heat discharging part 100 may be installed in a room, when an outlet of the heat absorbing part 200 is required to be directed to a direction cooling is required, and the heat discharging part 100 is directed to the other side. Of course, it is preferable that an appropriate measure is taken to direct a heat from the heat discharging part 100 to outside of the room.

Figure 6:
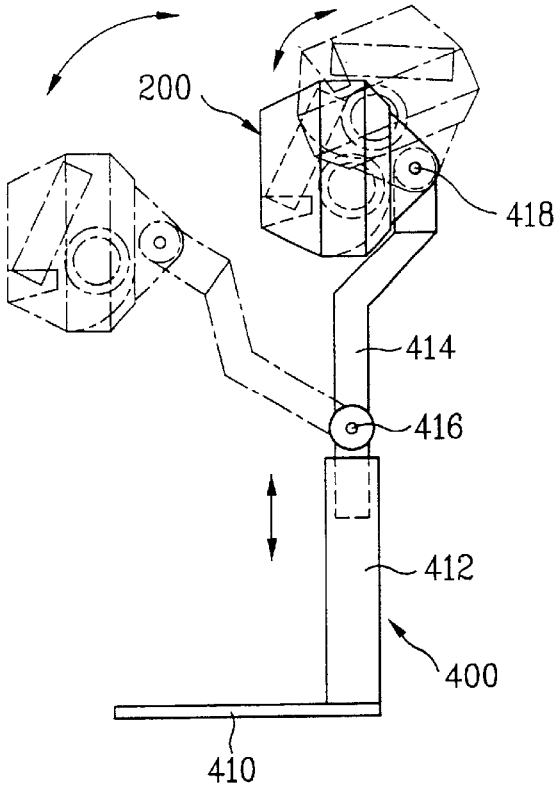
FIG. 6 illustrates a side view of a heat absorbing part of a personal air conditioner of the present invention for showing one example of an installation state thereof.

In the meantime, it is preferable that the heat absorbing part 200 is fixed to a heat absorbing part fixing means for easy installation of the heat absorbing part 200 at a desired location as a simple placement of the heat absorbing part fixing means fulfils the installation of the heat absorbing part 200. An embodiment of installation of the heat absorbing part of the air conditioner of the present invention will be explained, with reference to FIG. 6.

Figure 7:
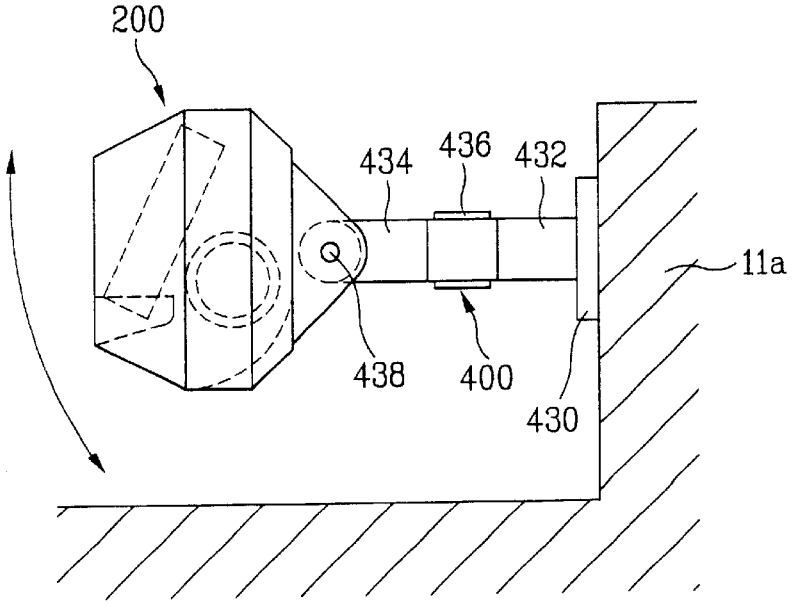
FIG. 7 illustrates a side view of a heat absorbing part of a personal air conditioner of the present invention for showing another example of an installation state thereof.
Figure 8:
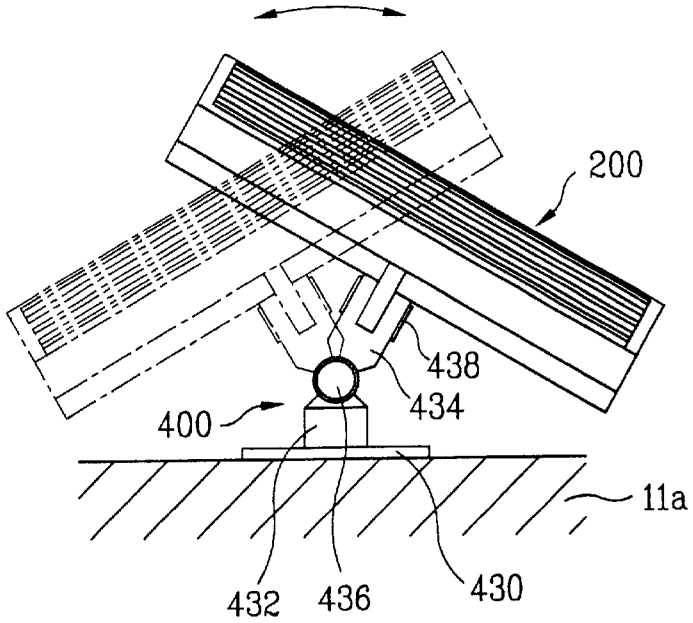
FIG. 8 illustrate a plan view of FIG. 7.

Heat absorbing part fixing means 400 is fixed to the heat absorbing part 200 for installation of the heat absorbing part at a desired location. It is perferable that the heat absorbing part fixing means 400 facilitates both an easy installation of the heat absorbing part 200 at a desired location and free change of a direction of a cooled air discharged form the heat absorbing part 200. That is, it is preferable that the heat absorbing part fixing means 400 includes a base 410 for supporting the heat absorbing part 200, height adjusting means fitted between the base 410 and the heat absorbing part 200 for adjusting a height of the heat absorbing part, and angle adjusting means for adjusting an angle. In detail, there is a first supporting member 412 fixed on the base 410 placed at a desired location, and a second supporting member 414 is coupled to a top of the first supporting member 412 for adjusting a height in up and down directions, at an end of which the heat absorbing part 200 is coupled. In this instance, it is preferable that the heat absorbing part 200 and the second supporting member 414 is coupled via a rotating means, for an example, a pin 418, for rotation in up and down directions to adjust a direction of the cooled air. And, it is preferable that a rotating means, for an example a pin 416, is further provided to a lower portion of the second supporting means 414, for rotating the second supporting member 414 itself. This construction permits a wider range of direction control of the cooled air discharged from the heat absorbing part 200. Therefore, according to this embodiment, an easy installation of the heat absorbing part 200 at a desired location is possible by placing the base 410 of the heat absorbing part 200 at the desired location. In this instance, the user may adjust height and angle of the heat absorbing part 200 in directing cooled air to a desired space for an effective cooling within a short time period. Other than the foregoing method, the heat absorbing part 200 may be installed by different methods. For example, the heat absorbing part 200 may be fixed to a wall surface as shown in FIGS. 7 and 8.

An installation configuration of a heat absorbing part of a personal air conditioner in accordance with a second preferred embodiment of the present invention will be explained, referring to FIGS. 7 and 8.

Similar to the first embodiment, the second embodiment heat absorbing part fixing means 400 includes a base 430, a first supporting part 432 fixed to the base 430, and a second supporting part 434 having one end fixed to the first supporting part 432 and the other end joined to the heat absorbing part 200. Of course, it is preferable that the second supporting part 434 has one end rotatably connected to the first supporting part 432 via one pin 436 and the other end rotatably connected to the heat absorbing part 200 via the other pin 438. However, different from the first embodiment, the base 430 is fixed to a wall. Consequently, an installation height of the heat absorbing part 200 can not be adjusted. Therefore, it is preferable that the pin 436 connecting the first supporting part 432 and the second supporting part 434 and the pin 438 connecting the second supporting part 434 and the heat absorbing part 200 are arranged at a right angle. That is, the second supporting part 434 is connected so as to be rotatable in left and right directions by the pin 346, and heat absorbing part 200 is connected so as to be rotatable in up and down direction, for permitting the heat absorbing part 200 rotatable in up and down and left and right directions. And, it is more preferable that the heat absorbing part fixing means 400 is detachable from the heat absorbing part 200 partly or entirely, so that, as the case demands, the heat absorbing part 200 is fixed to the wall, fitted to the heat absorbing part fixing means 400 having a movable base 410, or fitted to the heat discharging part 100 as one unit.

Figure 9:
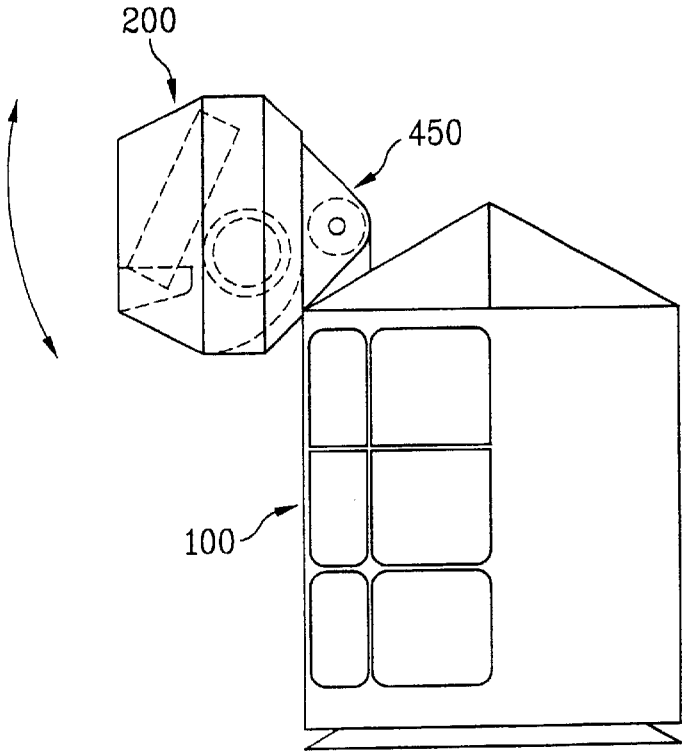
FIG. 9 illustrates a side view of a heat absorbing part of a personal air conditioner of the present invention for showing further example of an installation state thereof.

An installation configuration of a heat absorbing part of a personal air conditioner of the present invention will be explained, with reference to FIG. 9.

This embodiment shows an integration of the heat absorbing part 200 and the heat discharging part 100 for placing both of them in the room. Of course, it is preferable that the heat absorbing part 200 is rotatably fitted to the heat discharging part 100 by a rotatable mounting bracket 450. When the air conditioner includes the heat absorbing part 200 and the heat discharging part 100 integrated, an outlet of the heat absorbing part 200 is directed to a direction desired to be cooled, and the heat discharging part 100 is directed to the other side. Of course, it is preferable that an appropriate measure is taken for discharging the heat from the heat discharging part 100 to outside of the room.

As has been explained, the personal air conditioner of the present invention has the following advantages.

First, the easy installation and moving of the air conditioner of the present invention permits fast and intensive cooling of, not an entire space, but a particular space, allowing to use as a personal air conditioner.

Second, the free movement of air conditioner allows an efficient space utilization. And the easy storage of the heat absorbing part and the heat discharging part in separate spaces when not in use further allows an efficient utilization of the spaces.

Third, the intensive and quick cooling of a desired space permits an energy saving.

Fourth, the direction adjustment of cooled air discharged from the heat absorbing part in up, down, left, right direction permits a fast cooling down of a desired space.

Fifth, the convenient installation and movement of the heat absorbing part and the heat discharging part permits the air conditioner of the present invention to be used as a cooler or a heater without providing a separate device which reverses a flow of refrigerant in the air conditioner.

It will be apparent to those skilled in the art that various modifications and variations can be made in the personal air conditioner of the present invention without departing from the spirit or scope of the invention. Thus, it is intended that the present invention cover the modifications and variations of this invention provided they come within the scope of the appended claims and their equivalents.

What is claimed is:

1. A personal air conditioner comprising:

a heat discharging part having a small sized compressor and condenser;

a heat absorbing part having a small sized evaporator;

a flexible high pressure pipe line connected between the condenser and the evaporator; and a flexible low pressure pipe line connected between the evaporator and the compressor, wherein the heat absorbing part is rotatably connected to the heat discharging part, so that the heat absorbing part can be selectively tilted relative to the heat discharging part.

2. A personal air conditioner as claimed in claim 1, wherein the high pressure pipe line and the low pressure pipe line are detachable.

3. A personal air conditioner as claimed in claim 1, further comprising a flexible drain hose connected to the heat absorbing part for transferring condensate from the evaporator to outside of a room.

4. A personal air conditioner as claimed in claim 3, wherein the heat absorbing part is joined to the heat discharging part by a rotatable mounting bracket for permitting an easy installation of the heat absorbing part.

5. A personal air conditioner as claimed in claim 3, wherein both the heat discharging part and the heat absorbing part are installed in the room, and wherein an outlet of the heat absorbing part is directed in a desired cooling direction, and an outlet of the heat discharging part is directed in another direction.

6. A personal air conditioner as claimed in claim 4, wherein the rotatable mounting bracket includes a substantially horizontal pivot axis to allow the heat absorbing part to being angled in the up and down direction.

* * * * *